United States Patent [19]

Orr et al.

[11] 4,018,487

[45] Apr. 19, 1977

[54] CAM ADJUSTMENT FOR TENSION SPRING OF SEWING MACHINE HEAD LIFTER MECHANISM

[75] Inventors: John L. Orr; Robert A. Sewell, both of Rockford, Ill.

[73] Assignee: Keystone Consolidated Industries, Inc., Peoria, Ill.

[22] Filed: Mar. 25, 1976

[21] Appl. No.: 670,280

[52] U.S. Cl. ..... 312/27; 312/21; 312/26; 248/280

[51] Int. Cl.[2] ..... A47B 81/00

[58] Field of Search ..... 312/27, 21, 22, 24, 312/26; 248/280, 281, 378, 379, 204, 292, 123

[56] References Cited

UNITED STATES PATENTS

| | | | |
|---|---|---|---|
| 484,401 | 10/1892 | Bolton | 312/27 |
| 834,104 | 10/1906 | Borden | 248/280 |
| 1,178,488 | 4/1916 | Bolens | 248/378 |
| 1,500,425 | 7/1924 | Thurman et al. | 248/292 |
| 2,739,778 | 3/1956 | Krone et al. | 248/292 |
| 2,822,229 | 2/1958 | Carlson | 248/123 |
| 2,977,170 | 3/1961 | Hochman | 312/26 |
| 3,295,809 | 1/1967 | Smola et al. | 248/204 |
| 3,948,472 | 4/1976 | Metcalf | 248/280 |

*Primary Examiner*—Paul R. Gilliam
*Assistant Examiner*—Victor N. Sakran
*Attorney, Agent, or Firm*—Allegretti, Newitt, Witcoff & McAndrews

[57] ABSTRACT

An improved sewing machine head lifter mechanism for supporting a sewing machine head in a cabinet includes a support linkage with a spring support mechanism for the linkage. An adjustable cam member is provided for cooperation with the spring mechanism. Thus, the adjustable cam engages one end of a tension spring. The opposite end of the spring engages a head support bracket. The spring is supported intermediate its ends. Pivotal movement of the cam member adjusts tension of the spring to provide the requisite force for supporting the head support bracket and an attached sewing machine head.

3 Claims, 7 Drawing Figures

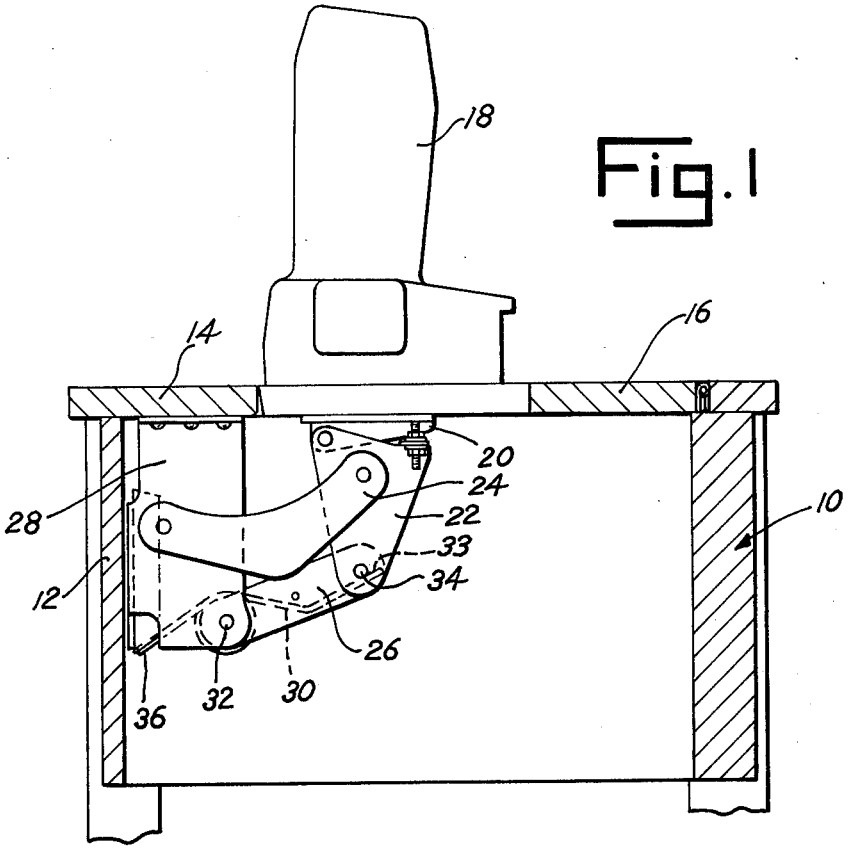
Fig. 1
Fig. 2
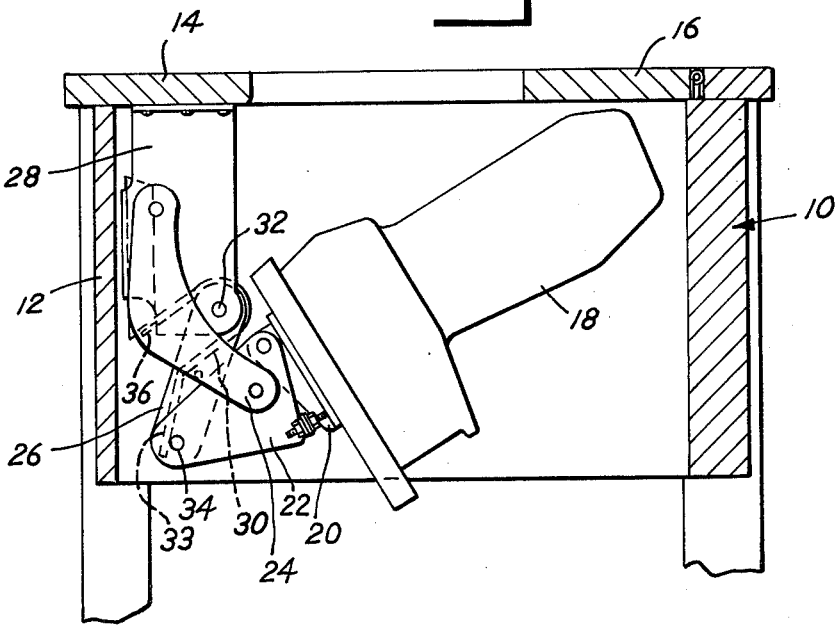

Fig. 5
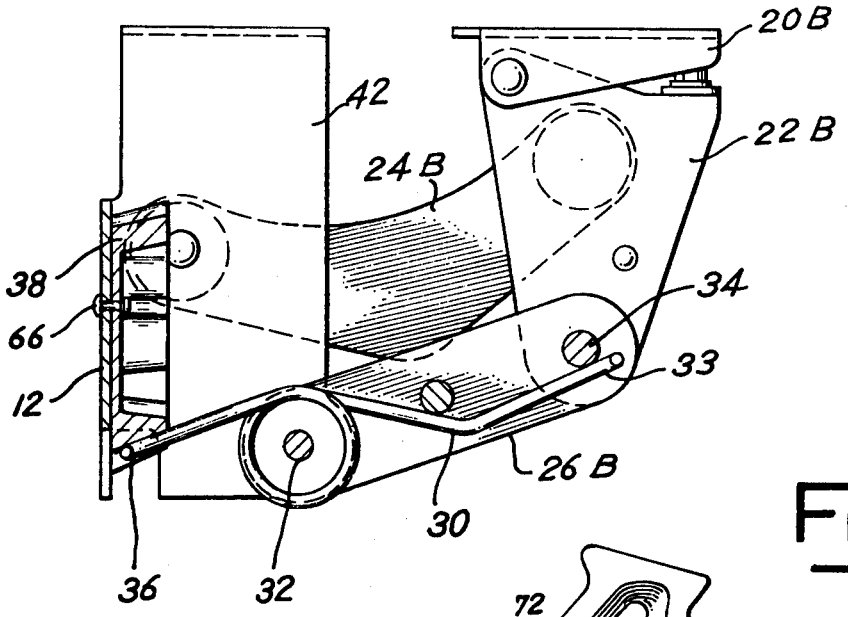
Fig. 6
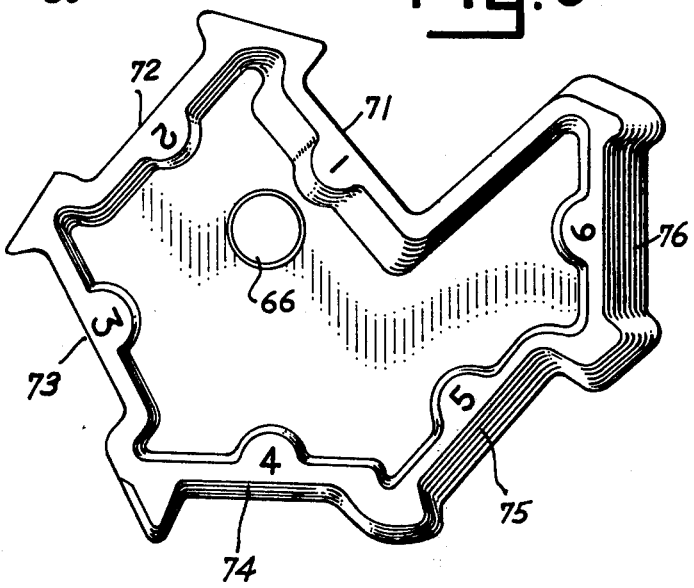
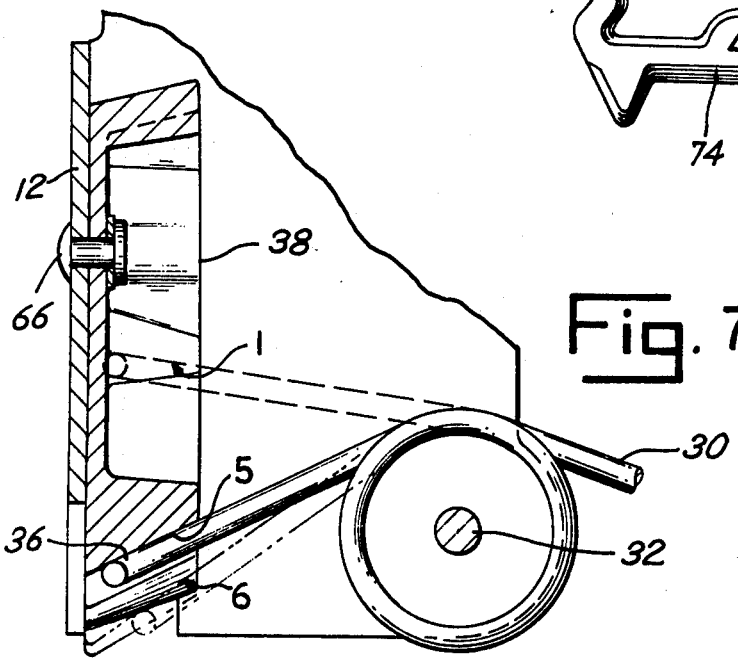
Fig. 7

CAM ADJUSTMENT FOR TENSION SPRING OF SEWING MACHINE HEAD LIFTER MECHANISM

BACKGROUND OF THE INVENTION

In a principal aspect, the present invention relates to an improved sewing machine head lifter mechanism including means for adjusting the force providing to support the head.

Typically, a sewing machine head is mounted on a cabinet or table. Preferably, the mounting arrangement for the head permits movement of the head into a concealed storage position within the cabinet. Movement of the head between the storage position and use position is augmented by a linkage mechanism attached to the bottom of the sewing machine head. The linkage mechanism is generally counterbalanced to assist in movement of the sewing machine toward an elevated use position. The linkage mechanism also permits movement of the sewing machine head to the interior of the cabinet for storage.

Various types of linkage mechanisms for support and attachment of a sewing machine head to a cabinet have been proposed. A typical linkage mechanism includes a housing which is attached to the interior of a cabinet. A support bracket is attached to the sewing machine head and linkage arms connect the bracket with the housing. The linkage arms pivot to permit movement of the bracket and attached head between a support or extended position and the retracted or storage position. A tension spring provides a means to counterbalance or compensate for the weight of the sewing machine head thereby making it easier to move the head between the projected position and the storage position. A tension spring normally must be customed designed and installed in the linkage mechanism for each model of a sewing machine head since each model of a head may vary in weight. Thus, the support force required for one model head may vary from another type. A desirable objective is to have a multi-purpose, universal head lifter mechanism which may be adjusted to accommodate the weight of the sewing machine head.

SUMMARY OF THE INVENTION

Briefly, the present invention comprises the improvement for a sewing machine head support or lifter mechanism of an adjustable spring tension mechanism. In the preferred embodiment, the adjustable spring tension mechanism includes a rotatable cam adjustable to any one of a number of positions each of which provides a distinct spring tension and weight support characteristic.

It is thus an object of the present invention to provide a sewing machine head lifter mechanism having a variety of settings for support of heads of various weight.

Another object of the present invention is to provide a cam mechanism for a sewing machine head lifter mechanism which may be easily adjusted to accommodate any one of a number of various weights supported by the linkage mechanism.

Still a further object of the present invention is to provide a lifter mechanism for supporting a sewing machine head which mechanism has a minimum number of parts, is economical to make and is efficient and easy to use.

These and other objects, advantages and features of the invention will be set forth in the detailed description which follows.

BRIEF DESCRIPTION OF THE DRAWINGS

In the detailed description which follows, reference will be made to the drawing comprised of the following figures:

FIG. 1 is a cross-sectional view of the improved support mechanism of the present invention installed in a sewing machine cabinet with the sewing machine head in the projected or use position;

FIG. 2 is a cross-sectional view of the cabinet of FIG. 1 wherein the sewing machine head has been moved to a concealed position within the cabinet;

FIG. 5 is a cross-sectional view of the mechanism of FIG. 3 taken along the line 5—5;

FIG. 6 is a cross-sectional view of the cam adjustment feature for the mechanism taken along the line 6—6 in FIG. 3; and FIG. 7 is an enlrged partial cross-sectional view of the cam shown in FIG. 5 wherein alternate cam positions are illustrated in phantom.

DESCRIPTION OF THE PREFERRED EMBODIMENT

Figure 3:
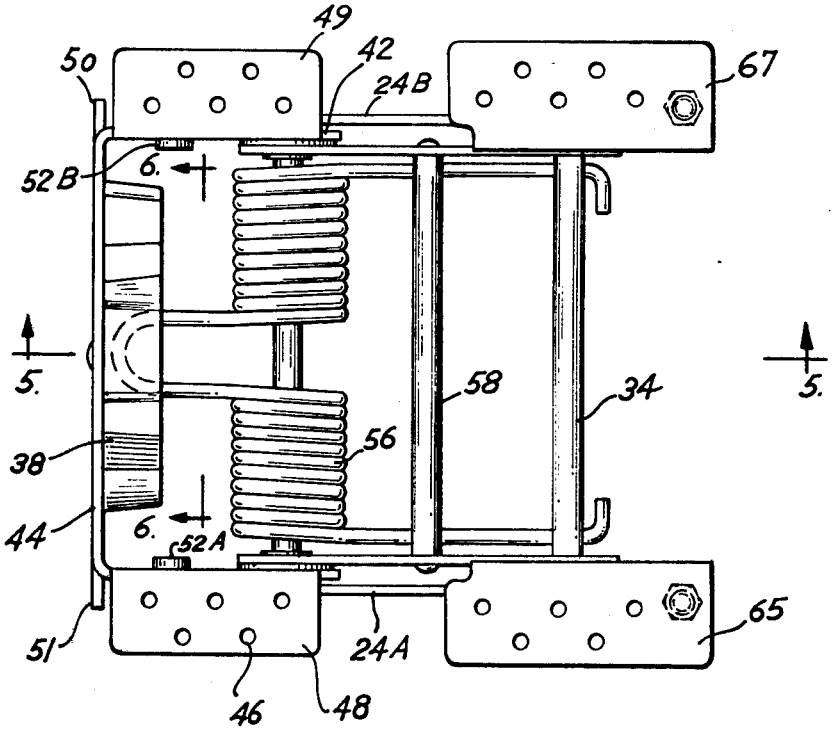
FIG. 3 is a top plan view of the improved mechanism of the present invention.

The improvement of the present invention relates particularly to a spring tension adjustment feature for the sewing machine head support mechanism or device illustrated in the drawings. The arrangement of linkage arms for the mechanism is not, by itself, new. Such a linkage arm arrangement is, upon information and belief, subject matter of a co-pending application owned by someone other than the assignee of the present application. The present invention constitutes an improvement over the specific linkage. Additionally, the present invention constitutes an improvement which may be used in combination with other linkages or mechanisms that support a sewing machine head or other items.

Referring, therefore, to FIGS. 1 and 2, a typical sewing machine head 18 is illustrated in combination with a support linkage installed in a sewing machine cabinet. Thus, cabinet 10 includes a back wall 12, a top deck or platform 14 having a hinged portion 16. A sewing machine head 18 is attached to an adjustable bracket 20 by appropriate fasteners such as bolts and is supported thereby. The adjustable bracket 20 is fixed to a head bracket 22. An upper arm 24 and lower arm 26 pivotally link head bracket 22 with a housing 28. Housing 28 is fastened to back wall 12 and platform 14 and is retained in a substantially fixed position.

A biasing spring 30 is wrapped around a rod 32 extending between wings or plate members 40 and 42 of housing 28. One end 33 of spring 30 is engaged with a bracket rod 34. The opposite end 36 of spring 30 engages a cam 38 attached to the housing 28. A downward force on end 36 acting through rod or fulcrum 32 generates an upward force on rod 34 through end 33. In this manner, the bracket 20 is supported or biased to maintain the head 18 in the projected position of FIGS. 1 and 5.

Figure 4:
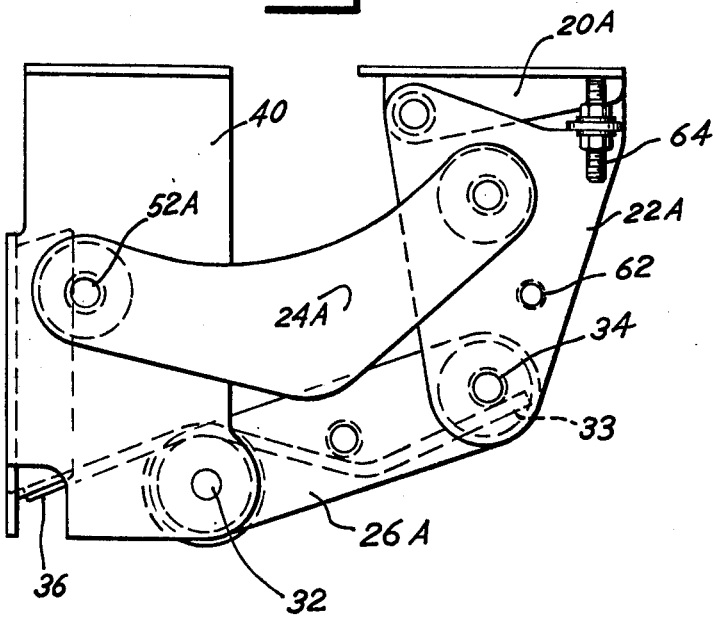
FIG. 4 is a side view of the improved linkage of the present invention wherein the mechanism has been placed in the projected position illustrated in FIG. 1.

FIGS. 3–7 illustrate in greater detail the structure of the linkage and support means for the head 18 including the adjustable spring tension feature, a feature which finds its origin in the structure and placement of cam 38. Thus, referring to FIGS. 3–7, the housing 28 comprises a single member having first and second parallel projecting plate members 40 and 42. Plate members 40 and 42 are joined together by connecting back plate member 44. The housing 28 is attached to cabinet 10 by means of fasteners (not shown) through openings such as opening 46 in flanges 48 and 49 comprising extensions from the plate members 40 and 42 respectively. Flanges 50 and 51 projecting from back plate member 44 also include openings for receipt of fastening means to attach housing 28 to cabinet 10.

Upper arms 24A and 24B are pivotally attached at one end to housing 28 by means of pivot members 52A and 52B respectively. The opposite ends of upper arms 24A and 24B are pivotally connected to head brackets 22A and 22B respectively. Lower arms 26A and 26B also pivotally connect with housing plate members 40 and 42 respectively and with head brackets 22A and 22B respectively. Note that uper arms 22A and 24B are attached on the outside of plate members 40 and 42 respectively. This construction avoids interference between upper arms 24 and lower arms 26. The specific relative lengths and position of arms 24 and 26 permit positioning of head bracket 22 as shown in FIGS. 1 and 2.

Spring mounting rod 32 extends between the plate members 40 and 42. The spring 30 which includes a center coil 56 fits over rod 32. Rod 32 thus serves as a fulcrum for the spring 30. The lower arms 26A and 26B are separated by means of a connected spacing rod 58. The lower arms 26A and 26B are pivotally positioned inside plate members 40 and 42 respectively, and cooperate with rod 32 at one end for mounting on bracket 22 and with rod 34 at the opposite end for mounting on housing 28. Stop pins 62 limit travel of the head brackets 22 by interference with lower arms 26A and 26B when pivoted.

Adjustable brackets 20A and 20B are pivotally attached to head brackets 22A and 22B respectively. The adjustable brackets 20A and 20B may be adjusted in height and angle of inclination by operation of threaded spacing stud 64. That is, stud 64 engages flanges 65 and 67 of brackets 20A and 20B, thereby controlling the amount of pivotal movement of the brackets 20A, 20B when head 18 is attached thereto.

The spring 30 includes one end 33, as previously described, cooperative with rod 34. The opposite end 34 cooperates with cam 38. Cam 38 is attached to the back plate member 44 and pivots about attachment rivet 66. The cam 38 includes a plurality of separate lands 71–76 each of which may cooperate with the opposite end 36 of spring 30. Each land 71–76 is a discrete, different distance from the center of the pivot axis or rivet 66 of cam 30. Thus, each land 71–76 provides a distinct and different downward force on the end 36 of spring 30. This force is in the counterclockwise sense as illustrated in the figures and imparts an upward force in the same counterclockwise sense through the end 33 of spring 30 on the rod 34 connected to head bracket 22.

Land 76, in the example shown, provides the greatest force in the counterclockwise sense since land 76 is most greatly separated from mounting rivet 66. Land 71 provides the least amount of force. As a result, it is possible to vary the force on the spring 30 and thereby compensate for variable weight which will be placed on the adjustable bracket 20. Heavier weights will require greater spring tension in order to achieve proper counterbalancing. Lighter weights or lighter sewing machine heads require less spring tension for counterbalancing.

FIG. 7 illustrates in phantom the difference between the land 71 associated with the least amount of spring 30 force, and the land 76 associated with the most amount of spring 30 force for the embodiment disclosed. The remaining lands 72–75 provide intermediate forces between the extremes represented by land 71 and land 76.

It is possible to vary the structure of the present invention without departing from the scope of the invention. The invention therefore is to be limited only by the following claims and their equivalents.

What is claimed is:

1. In a mechanism for supporting a sewing machine head from a cabinet, said mechanism of the type including a housing for mounting on the cabinet, bracket means for attachment to the machine head, linkage arms pivotally attached between the housing and the bracket means, said bracket means being transportable by the arms between a projected head support position and a retracted position, and spring means for biasing the bracket means toward the head support position, the improvement of adjustable spring tension means engaging the spring means to provide adjustable support force by the bracket means for a head, said spring means including an adjustable cam member attached to the housing, a center fulcrum affixed to the housing, a biasing spring having generally oppositely extending first and second ends flexibly connected, said spring being pivoted at the fulcrum so that a force in a counterclockwise sense on the first end of the spring is transmitted through the coil member to impart a counterclockwise force at the second end and vice versa, the first end being held by the cam member attached to the housing and the second end being biased against the bracket, said cam member being pivoted about an axis generally transverse to the axis of the fulcrum to provide any one of a plurality of sring engaging surfaces for contact with the first end, each of said surfaces being separately spaced from the cam pivot axis to provide a distinct force against the first end of the spring which force is imparted to the bracket means for support of a head mounted thereon.

2. The improvement of claim 1 wherein said spring engaging surfaces are arranged about the circumference of a generally circular cam member and wherein the radial distance from the pivot axis to each separate successive cam surface is distinct.

3. The improvement of claim 2 wherein the radial distance for each successive cam surface increases from a minimum to a maximum value, the force imparted through the spring means for the minimum radial distance setting of the cam member being less than the force associated with each succeeding cam surface.

* * * * *